US007768464B2

(12) United States Patent
Lee et al.

(10) Patent No.: US 7,768,464 B2
(45) Date of Patent: Aug. 3, 2010

(54) ANTENNA DEVICE

(75) Inventors: Yi Ju Lee, Tu-Cheng (TW); An Yu Yen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 172 days.

(21) Appl. No.: 12/222,131

(22) Filed: Aug. 4, 2008

(65) Prior Publication Data

US 2010/0026591 A1 Feb. 4, 2010

(51) Int. Cl.
*H01Q 1/24* (2006.01)

(52) U.S. Cl. ..... 343/702; 343/846

(58) Field of Classification Search ..... 343/700 MS, 343/702, 829, 846
See application file for complete search history.

(56) References Cited

U.S. PATENT DOCUMENTS 6,246,371 B1 * 6/2001 Kurz et al. ..... 343/702
6,563,466 B2 * 5/2003 Sadler et al. ..... 343/702
6,734,825 B1 * 5/2004 Guo et al. ..... 343/700 MS
7,230,574 B2 * 6/2007 Johnson ..... 343/702
7,256,743 B2 * 8/2007 Korva ..... 343/702
7,466,272 B1 * 12/2008 Su et al. ..... 343/700 MS
2010/0060525 A1 * 3/2010 Yang et al. ..... 343/700 MS

* cited by examiner

*Primary Examiner*—Tho G Phan
(74) *Attorney, Agent, or Firm*—Rosenberg, Klein & Lee

(57) ABSTRACT

An antenna device includes a supporting body and an antenna. The supporting body has two arms and a connecting portion disposed between and connecting the two arms. The antenna has a grounding portion extending from one end of one of the arms. A free end of the grounding portion perpendicularly extends toward the other arm to form a first radiating strip, and a second radiating strip, a third radiating strip and a fourth radiating strip are respectively integrally formed in turn. The first, second, third and fourth radiating strips together define substantially a rectangular shape. A feed-in portion extends from the first radiating strip. The grounding portion connects the supporting body functioning as a ground of the antenna, which increases the area of the grounding for the antenna and enhances the performance of signal transmitting and receiving of the antenna device.

6 Claims, 6 Drawing Sheets

ANTENNA DEVICE

BACKGROUND OF THE INVENTION

1. Field of the Invention

The present invention relates to an antenna device, and particularly to an antenna device with a grounding structure.

2. The Related Art

Wireless communication devices, such as cellular phones, notebook computers, electronic appliances, and the like, are normally installed with an antenna that servers as a medium for transmission and reception of electromagnetic signals. The antenna may be mounted outside or in the device. In general use, the antenna is built-in the device to save space and increase convenience. A conventional antenna device is illustrated in FIG. 7 and includes a printed circuit board 92 and an antenna 94. The antenna 94 with a grounding point 95 and a feed-in point 96 is arranged close to the surface of the printed circuit board 92. The grounding point 95 and the feed-in point 96 are electrically coupled with the printed circuit board 92. A metal layer (not labeled) provided on the surface of the printed circuit board 92 functions as a ground for the antenna 94.

However, as the wireless communication devices tend to be miniaturized, the size of the printed circuit board accordingly becomes smaller and smaller. The area of the printed circuit board used for functioning as the ground is restricted. Reduction of the area of the ground weakens the performance of transmitting and receiving electromagnetic signals of the antenna device.

SUMMARY OF THE INVENTION

Accordingly, an object of the present invention is to provide an antenna device with improved structure to enhance the performance of transmitting and receiving electromagnetic signals. The antenna device adapted for an electrical device and electrically connected to a conductor shell of the electrical device includes a supporting body and an antenna. The supporting body has two arms and a connecting portion disposed between the two arms and connected with the two arms. The antenna has a grounding portion extending from one end of one of the arms of the supporting body. A free end of the grounding portion substantially perpendicularly extends toward the other arm to form a first radiating strip substantially perpendicular to the grounding portion. A free end of the first radiating strip extends downwardly to form a second radiating strip substantially perpendicular to the first radiating portion. A free end of the second radiating strip extends toward the grounding portion to form a third radiating strip substantially perpendicular to the second radiating strip. A free end of the third radiating strip extends toward the first radiating strip to form a fourth radiating strip substantially perpendicular to the third radiating strip. The first, second, third and fourth radiating strips together define substantially a rectangular shape. A feed-in portion extends from the first radiating strip and extends toward the third radiating strip.

The grounding portion of the antenna is connected to the supporting body, thus the supporting body can function as a ground of the antenna, which increases the area of the ground for the antenna and enhances the performance of transmitting and receiving electromagnetic signal of the antenna device.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
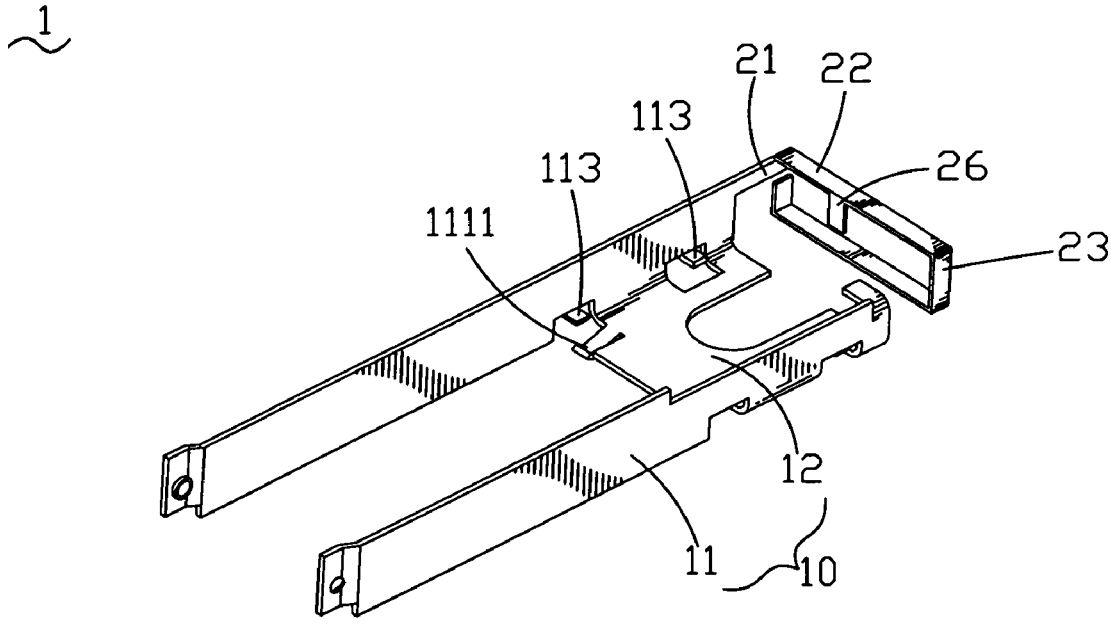
FIG. 1 is a perspective view of an antenna device according to the present invention.
Figure 2:
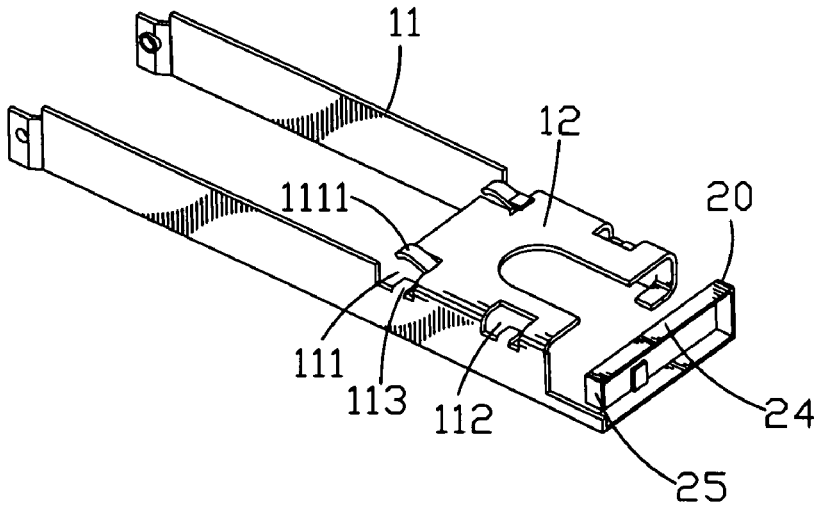
FIG. 2 is another perspective view of the antenna device in FIG. 1.

Referring to FIG. 1 and FIG. 2, a preferred embodiment of an antenna device 1 according to the present invention is shown. The antenna device 1 may be mounted to an electrical device (not shown) and may include a supporting body 10 and an antenna 20 that is preferably an integrally molded portion of the supporting body 10. The supporting body 10 and the antenna 20 are made of metallic material.

The supporting body 10 includes two arms 11 and a connecting portion 12 connecting the two arms 11 together at respective bottom sides thereof. The arms 11 are elongated plates and parallel to each other. A junction formed between the connecting portion 12 and each arm 11 is cut to form a first opening 111 and a second opening 112. Each first opening 111 is separated from corresponding second opening 112. The first openings 111 are disposed at one end of the connecting portion 12 while the second openings 112 are disposed at a vicinity of the other end of the connecting portion 12 opposite to the first openings 111. Supporting pieces 113 respectively extend inwardly from upper sides of the first openings 111 and the second openings 112 on the arms 11. The supporting pieces 113 are perpendicular to the arms 11 and all the supporting pieces 113 are arranged at a common plane. A pair of contact portions 1111 of arc-shape respectively extends from the sides of the first openings 111 on the connecting portion 12. The contact portions 1111 are located beyond the bottom of the connecting portion 12.

The antenna 20 has a grounding portion 21 extending from one end of one of the arms 11 of the supporting body 10. A first radiating strip 22 perpendicularly extends from a free end of the grounding portion 21 toward the other arm 11. A free end of the first radiating strip 22 perpendicularly extends downwardly to form a second radiating strip 23. The second radiating strip 23 is parallel to the arms 11. A free end of the second radiating strip 23 perpendicularly extends toward the grounding portion 21 to form a third radiating strip 24 which is parallel to the first radiating strip 22. The third radiating strip 24 shares a common plane with the supporting pieces 113 of the supporting body 10. A free end of the third radiating strip 24 perpendicularly extends toward the first radiating strip 22 to form a fourth radiating strip 25. The fourth radiating strip 25 is parallel to the second radiating strip 23 and shares a common plane with the grounding portion 21. The tip of the fourth radiating strip 25 faces the free end of the grounding portion 21 and maintains a gap therebetween. The first radiating strip 22, the second radiating strip 23, the third radiating strip 24 and the fourth radiating strip 25 are all rectangular flakes. A feed-in portion 26 perpendicularly extends downwardly from the middle of the first radiating strip 22 toward the third radiating strip 24. The tip of the feed-in portion 26 maintains a gap with the third radiating strip 24. The total electrical length of the first radiating strip 22, the second radiating strip 23, the third radiating strip 24 and the fourth radiating strip 25 is substantially equal to a quarter of the wavelength corresponding to a frequency 2.4 GHz. In addition, the first, second, third and fourth radiating strips together define substantially a rectangular shape.

Figure 3:
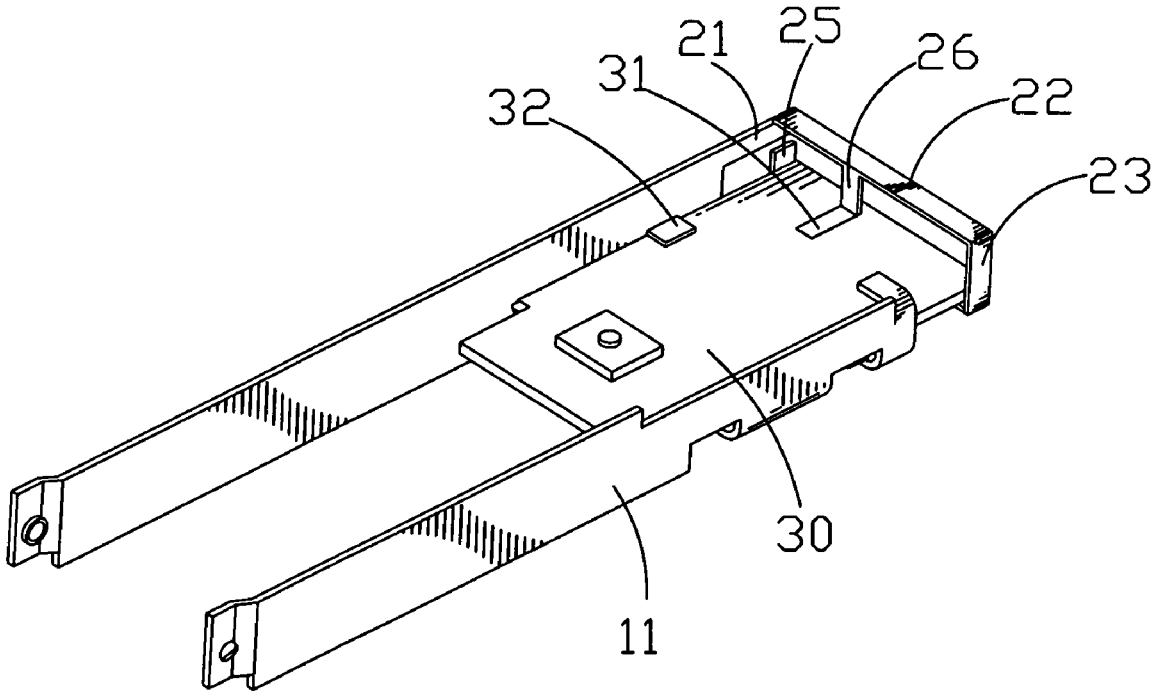
FIG. 3 is a perspective view of the antenna device shown in FIG. 1 and having a printed circuit board installed thereon.

Please refer to FIGS. 1-3, a printed circuit board 30 is installed on the supporting body 10. One end of the printed circuit board 30 is supported on the third radiating strip 24 of the antenna 20. Two lateral sides of the printed circuit board 30 is pressed against respectively the two arms 11 and are supported on the supporting pieces 113 of the supporting body 10. A space is formed between the printed circuit board 30 and the connecting portion 12. The supporting pieces 113 are soldered to the printed circuit board 30. The printed circuit board 30 has a connecting component 31 and a grounding point 32 formed thereon. One end of the connecting component 31 is connected to the tip of the feed-in portion 26 of the antenna 20, and the opposite end thereof is electrically connected to a feed circuit (not shown) on the printed circuit board 30. The grounding point 32 is electrically connected with one of the supporting pieces 113 nearest the grounding portion 21, which makes the supporting body 10 be a common ground of the antenna 20 and the printed circuit board 30. The contact portions 1111 of the supporting body 10 connect a conductor shell (not shown) of the electrical device, which makes the conductor shell and the supporting body 10 be a ground together.

When the antenna device 1 operates during wireless communication, the circuit of the printed circuit board 30 transmits the current to the antenna 20 via the feed-in portion 26 of the antenna 20. The total length of the first radiating strip 22, the second radiating strip 23, the third radiating strip 24 and the fourth radiating strip 25 resonate at the frequency 2.4 GHz.

Figure 4:
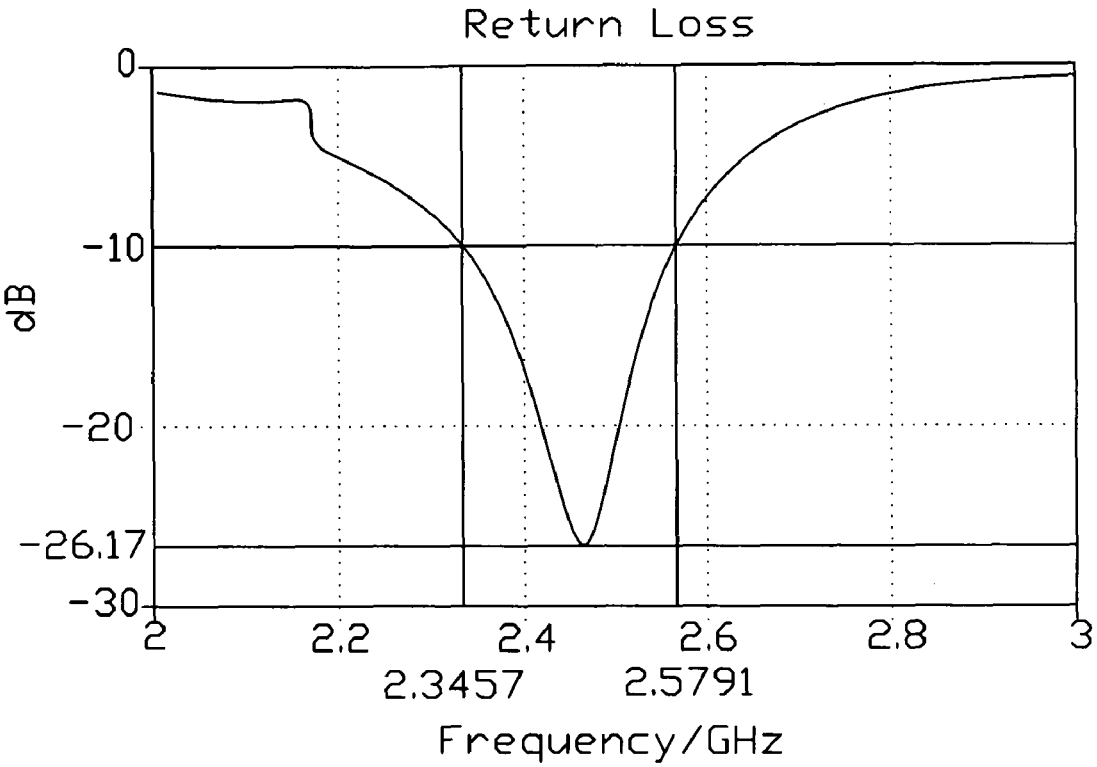
FIG. 4 shows a Return Loss test chart of the antenna device.

Referring to FIG. 4, which shows a Return Loss test chart of the antenna device 1 when the antenna device 1 is installed to the electrical device. When the antenna device 1 operates at the frequency range covering between 2.3457 GHz and 2.5791 GHz, the Return Loss of the antenna device 1 is between −10 dB and −26.17 dB, which complies with the standard of electromagnetic signal transmitting.

Figure 5:
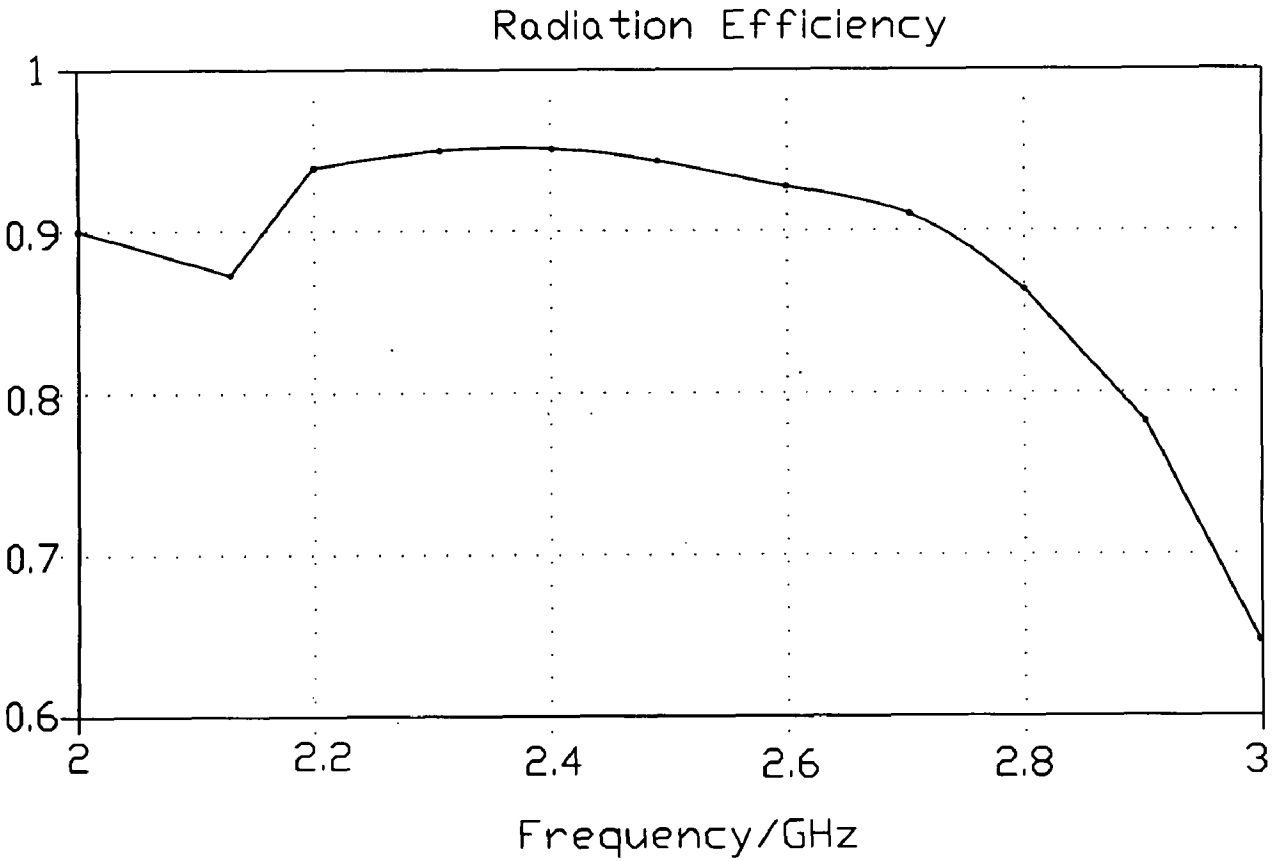
FIG. 5 shows a Radiation Efficiency test chart of the antenna device.

Referring to FIG. 5, which shows a Radiation Efficiency test chart of the antenna device 1 when the antenna device 1 is mounted to the electrical device. When the antenna device 1 operates at the frequency range covering between 2.3 GHz and 2.6 GHz, the Radiation efficiency is greater than 90 percent.

Figure 6:
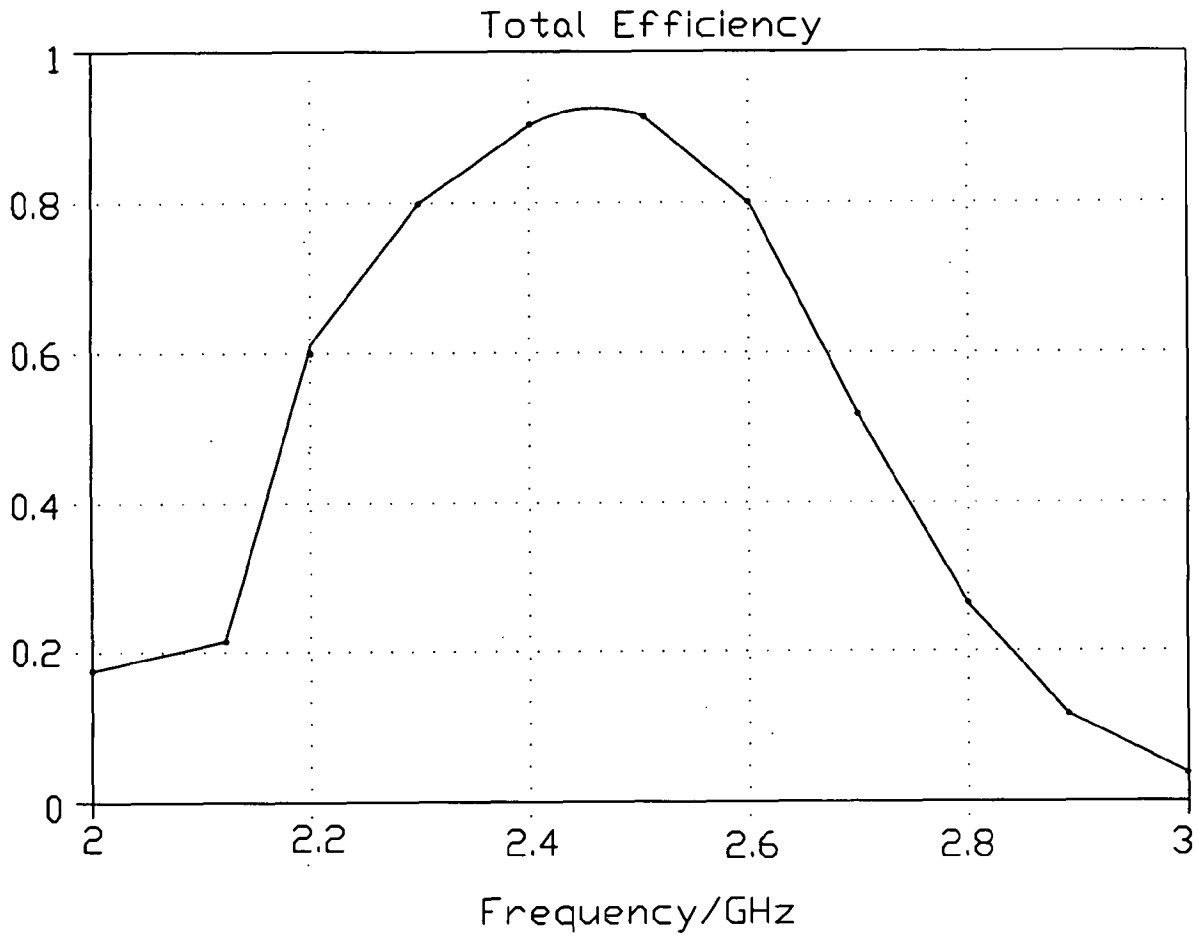
FIG. 6 shows a Total Efficiency test chart of the antenna device.
Figure 7:
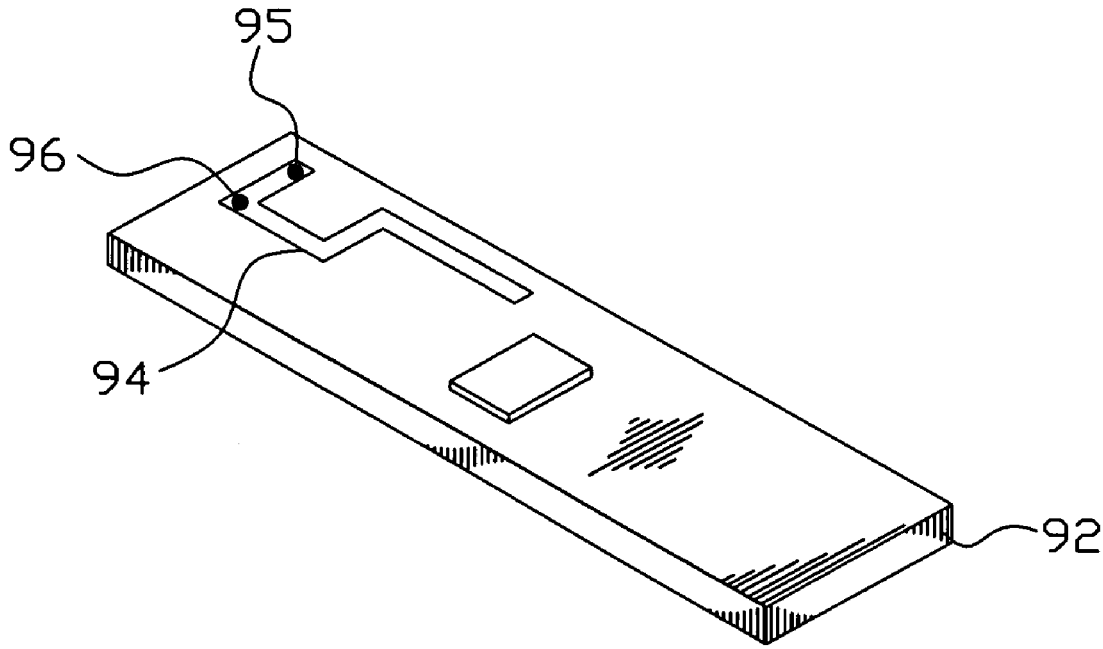
FIG. 7 (Prior Art)
FIG. 7 is a perspective view of a conventional antenna device.

Referring to FIG. 6, which shows a Total Efficiency test chart of the antenna device 1 when the antenna device 1 is positioned to the electrical device. When the antenna device 1 operates at the frequency range covering between 2.3 GHz and 2.6 GHz, the Total Efficiency is greater than 80 percent.

As described above, the supporting body 10 of the antenna device 1 according to the present invention is connected to the grounding portion 21 of the antenna 20 and defines two contact portions 1111 to connect the conductor shell of the electrical device, thereby the supporting body 10 and the conductor shell function as a ground of the antenna 20, which increases the area of the ground for the antenna 20. Because the area of the grounding for the antenna 20 is increased, the performance of electromagnetic signal transmitting and receiving of the antenna device 1 is enhanced. Further, one of the supporting pieces 113 of the supporting body 10 is soldered to the grounding point 32 of the printed circuit board 30, which makes the supporting body 10 be a ground of the printed circuit board 30. Therefore, the interference of the antenna 20 from electrical elements which are disposed on the printed circuit board 30 is abated, which further enhances the performance of electromagnetic signal transmitting and receiving of the antenna device 1.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An antenna device adapted to be used in an electrical device and electrically connected to a conductor shell of the electrical device, comprising:

a supporting body having two arms substantially parallel with each other and a connecting portion disposed between and connected with the two arms at lower portions of the two arms; and an antenna having a grounding portion extending from one end of one of the arms of the supporting body, a free end of the grounding portion extending toward the other arm to form a first radiating strip substantially perpendicular to the grounding portion, a free end of the first radiating strip extending downwardly to form a second radiating strip substantially perpendicular to the first radiating strip, a free end of the second radiating strip extending toward the grounding portion to form a third radiating strip substantially perpendicular to the second radiating strip, a free end of the third radiating strip extending toward the first radiating strip to form a fourth radiating strip substantially perpendicular to the third radiating strip, a feed-in portion extending toward the third radiating strip from the first radiating strip, the first, second, third and fourth radiating strips together defining substantially a rectangular shape.

2. The antenna device as claimed in claim 1, further comprising a printed circuit board disposed in the supporting body, one end of the printed circuit board being supported on the third radiating strip of the antenna, the printed circuit board having a connecting component electrically connected with the feed-in portion, and a grounding point electrically connected to the supporting body.

3. The antenna device as claimed in claim 2, wherein the arms protrude towards each other to form a plurality of supporting pieces located above the connecting portion and at substantially same plane with the third radiating strip for supporting the printed circuit board.

4. The antenna device as claimed in claim 3, wherein the junctions of the connecting portion and the two arms are respectively cut to form a plurality of openings, the supporting pieces extend from upper sides of the openings formed on the arms.

5. The antenna device as claimed in claim 1, wherein the connecting portion of the supporting body protrudes downwardly to form contact portions for connecting the conductor shell of the electrical device.

6. The antenna device as claimed in claim 1, wherein the total electrical length of the first radiating strip, the second radiating strip, the third radiating strip and the fourth radiating strip is substantially equal to a quarter of the wavelength corresponding to a frequency 2.4 GHz.

* * * * *